US007530568B2

(12) United States Patent
Uchida et al.

(10) Patent No.: US 7,530,568 B2
(45) Date of Patent: May 12, 2009

(54) DOUBLE-SIDED DOCUMENT TRANSPORT DEVICE

(75) Inventors: Toru Uchida, Shizuoka (JP); Yoshio Idogawa, Tokyo (JP)

(73) Assignee: NEC Corporation, Tokyo (JP)

( * ) Notice: Subject to any disclaimer, the term of this patent is extended or adjusted under 35 U.S.C. 154(b) by 337 days.

(21) Appl. No.: 11/137,439

(22) Filed: May 26, 2005

(65) Prior Publication Data

US 2005/0263956 A1 Dec. 1, 2005

(30) Foreign Application Priority Data

May 28, 2004 (JP) ..... 2004-159412

(51) Int. Cl.
*B65H 5/02* (2006.01)

(52) U.S. Cl. ..... 271/273; 271/225; 271/116

(58) Field of Classification Search ..... 271/116, 271/273, 225

See application file for complete search history.

(56) References Cited

U.S. PATENT DOCUMENTS

| | | | | | |
|---|---|---|---|---|---|
| 4,176,834 | A | * | 12/1979 | Takahashi | 271/116 |
| 4,799,079 | A | * | 1/1989 | Ujino et al. | 399/374 |
| 4,921,239 | A | * | 5/1990 | Okui et al. | 271/186 |
| 5,110,104 | A | * | 5/1992 | Wakao et al. | 271/3.03 |
| 5,428,431 | A | * | 6/1995 | Abe et al. | 399/396 |
| 5,594,486 | A | * | 1/1997 | Kiyohara | 347/104 |
| 5,634,635 | A | * | 6/1997 | Kobayashi et al. | 271/3.16 |
| 5,755,435 | A | * | 5/1998 | Fujiwara | 271/4.04 |
| 5,854,965 | A | * | 12/1998 | Kasiwabara et al. | 399/381 |
| 6,000,693 | A | * | 12/1999 | Tranquilla | 271/263 |
| 6,059,279 | A | * | 5/2000 | Wenthe, Jr. | 271/10.13 |
| 6,161,829 | A | * | 12/2000 | Kusumi | 271/9.05 |
| 6,279,893 | B1 | * | 8/2001 | Ohkawa et al. | 271/10.12 |
| 2001/0022422 | A1 | * | 9/2001 | Tamura | 271/10.03 |

FOREIGN PATENT DOCUMENTS

| | | |
|---|---|---|
| JP | 63-295334 | 12/1988 |
| JP | 9-86807 | 3/1997 |
| JP | 2000-89524 | 3/2000 |
| JP | 2003-104631 | 4/2003 |
| JP | 2003-212380 | 7/2003 |
| JP | 2003-415629 | 12/2003 |

* cited by examiner

*Primary Examiner*—Patrick H Mackey
*Assistant Examiner*—Howard Sanders
(74) *Attorney, Agent, or Firm*—Whitham Curtis Christofferson & Cook, P.C.

(57) ABSTRACT

In a double-sided document transport device having a document reverse mechanism for suppressing the occurrence of jam and deterioration of read image, after a document is transported to a reading position, it is transported to the reading position again to read a rear side thereof through a reverse path. The device has discharge rollers disposed on an upper side and pinch rollers disposed on a lower side. The discharge rollers discharge a document as well as guides it to the reverse path by reversing it while claming the rear end thereof. The pinch rollers are fixed, and the discharge rollers are separated therefrom approximately upward about a rotation shaft of a transport unit. For this purpose, the discharge rollers are pressed against the pinch rollers and separated therefrom by a cancel lever. A drive system has two transmission routes one of which is reversed through a torque limiter and the other is reversed through an electromagnetic clutch.

5 Claims, 9 Drawing Sheets

(SECTION 1-1)

FIG.9B (SECTION 2-2)

DOUBLE-SIDED DOCUMENT TRANSPORT DEVICE

BACKGROUND OF THE INVENTION

1. Field of the Invention

The present invention relates to a document transport device for transporting sheets such as documents and the like used in a copy machine, a scanner, a facsimile device, and the like, and more particularly, to a double-sided document transport device for reading the image information recorded on both the sides of a sheet-like document from each side thereof.

2. Description of the Related Art

Heretofore, many of sheet-like documents such as a printed matter and the like often have image information printed or recorded on both the sides thereof. There have been proposed various types of sheet transport devices which can read the image information recorded on both the sides of a document. Many of the sheet transport devices used to read a document read image information by a raster scan system using a one-dimensional image sensor by moving a reading side of the document on a platen glass. To read the image information recorded on both the sides of a document by this type of the sheet transport device, after one reading side of the document is read, the document must be moved with the other reading side thereof in confrontation with the platen glass. For this purpose, a device for automatically reading both the sides of a document must be provided with a reverse mechanism for reversing a reading side after one side of the document is read.

Incidentally, an ordinary sheet transport device used to read a document transports various types of documents as subjects for transportation. Accordingly, the ordinary sheet transport device cannot entirely eliminate the danger that a document is jammed in a transport mechanism. In a sheet transport device having a reverse mechanism for reversing a document, a transport path is more complex than that of a sheet transport device for reading only one side of a document, and thus danger of the occurrence of jam is increased. To cope with this problem, there have been proposed sheet transport devices provided with various countermeasures against jam.

For example, there is proposed a double-sided document transport device which transports documents in such a manner that they are separated from a bundle of a plurality of documents one by one and stop at a reading position (for example, refer to Japanese Patent Publication No. 09-86807A).

There is a description of separation of a discharge roller in the conventional double-sided document transport device. However, since the discharge roller is disposed to a lower side and remains exposed from a document guide, the document transport device has a drawback in that when it is intended to guide a document to a reverse path after the image information recorded on the front side thereof is read, a document having been discharged may become entangled.

FIGS. 1A and 1B show the drawback. In the figures, reference numeral 400 denotes a bundle of documents having been read and discharged, and reference numeral 401 denotes a document discharged finally among them. As shown in FIG. 1A, the rear end of a document having been discharged is often in contact with a lower roller 501 for a while. Here, attention must be paid to that the lower roller 501 is a discharge roller and is composed of a material such rubber and the like.

When the processing of the front side of a document 601, which is being read at present, is finished and the discharge roller 501 begins to rotate reversely to read the rear side of the document, the document 401 discharged finally becomes entangled in the device together with the document 601 as shown in FIG. 1B. As a result, there occur drawbacks such as jam, irregularly stacked documents, and the like.

Further, the above conventional example describes nothing as to methods of separating the discharge roller and reversing the rotating direction thereof.

To overcome the above drawback, for example, a discharge roller is disposed on an upper side, and a pinch roller is disposed under the discharge roller to press a document against the discharge roller. This type of the pinch roller does not require feed force and can be molded of polyacetal resin and the like. Even if the pinch roller is rotate reversely, there is not a possibility that a discharged document becomes tangled therewith, thereby the above drawback can be overcome.

However, a new problem is caused by the discharge roller because it is disposed on the upper side. It is most effective to permit the vicinity of a discharge section to be opened and closed to take out a jammed document, and further it is preferable to separate the discharge roller from the pinch roller when the vicinity of the discharge section is opened.

In contrast, it is effective to use the shaft of the discharge roller also as a shaft for opening and closing the discharge section. In this case, however, since the position of the discharge roller cannot be changed to execute an open/close operation, it is difficult to separate the discharge roller from the pinch roller.

That is, there arises a new problem as to how drive force is transmitted to the discharge roller from the outside when the discharge section is closed while automatically separating the discharge roller from the pinch roller when the discharge section opened.

SUMMARY OF THE INVENTION

Accordingly, an object of the present invention is to provide a double-sided document transport device which is arranged such that after a document is transported to a reading position, it is transported to the reading position again through a reverse path to read the rear side of the document and which includes discharge rollers, which discharge the document after it is read as well as guides the document to the reverse path after it is reversed with its rear end clamped and to which drive force is transmitted by a simple mechanism, and a mechanism for separating the discharge rollers from pinch rollers.

To solve the above problem, in the present invention, the drive force is transmitted to the discharge rollers from a drive shaft supported on a frame, and the drive shaft is driven from the outside through a second shaft passing through an open/close fulcrum of a transport unit.

Further, it is also contemplated to move the pinch rollers up and down when the discharge rollers are separated from the pinch rollers. In this case, however, there is a possibility that a reading image is disturbed by an impact when the document is momentarily pressed upward when the separate state between the discharge rollers and the pinch rollers is cancelled.

FIG. 2A shows a both-side document transport operation executed by discharge rollers 117 and pinch rollers 123. In a system for moving the pinch rollers up and down, since a document is ordinarily in contact with the pinch rollers 123 on a lower side by its own weight while a discharge section is separated as shown in FIG. 2B, when the separate state of the discharge section is cancelled in the state that the document is in contact with the pinch rollers 123, it is lifted up momentarily. Since the separate state of discharge section is ordinarily canceled while the rear side of the document is being read, the quality of a read image is adversely affected thereby.

As shown in FIG. 2C, the problem is solved by fixing the pinch rollers 123 on the lower side and separating the upper discharge rollers 117 on an upper side upward.

A first effect of the present invention resides in that since the discharge rollers are mounted on the upper side, a document can be prevented from becoming entangled when the discharge rollers are rotate reversely.

A second effect of the present invention resides in that since the discharge rollers are separated from the pinch rollers by opening the vicinity of the discharge section, a jammed document can be easily taken out.

A third effect of the present invention resides in that since a document moves less when the separate state of the discharge rollers and the pinch rollers is cancelled, the quality of a read image is stabilized.

BRIEF DESCRIPTION OF THE DRAWINGS

FIGS. 9A and 9B are sectional views of the main portion of the vicinity of the discharge roller shown in FIG. 8.

DESCRIPTION OF THE PREFERRED EMBODIMENTS

Next, an embodiment of the present invention will be explained with reference to the drawings.

Figures 1A, 1B:
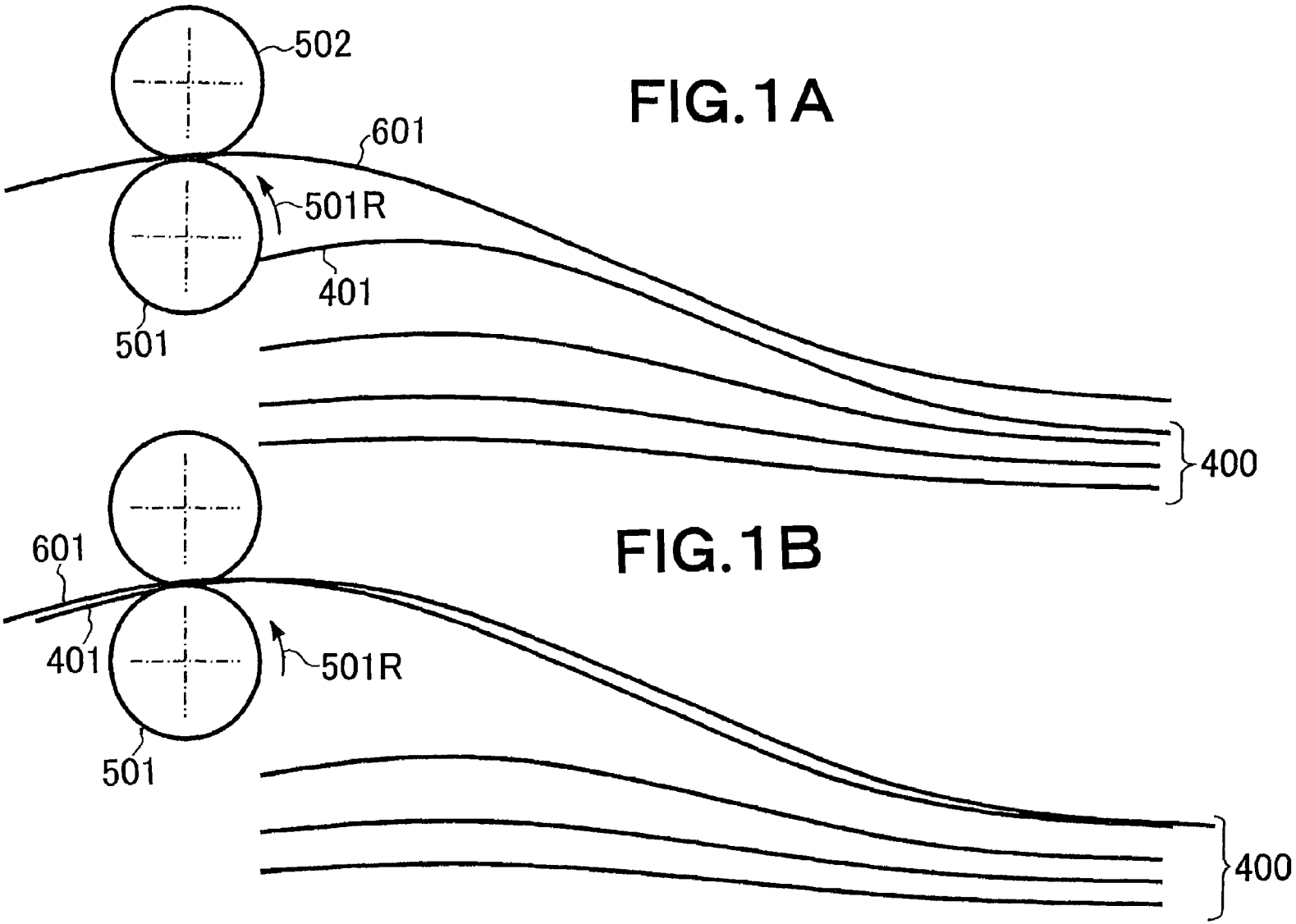
FIGS. 1A and 1B are views explaining problems of a conventional art.
Figure 2A:
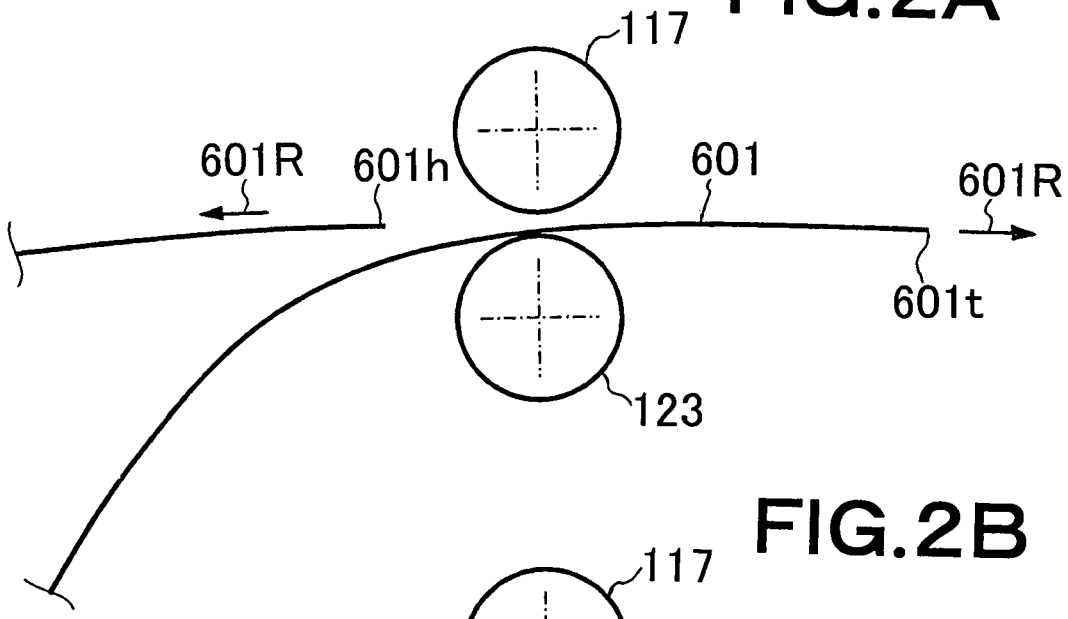
FIGS. 2A, 2B, and 2C are views explaining problems of the conventional art.
Figure 2B:
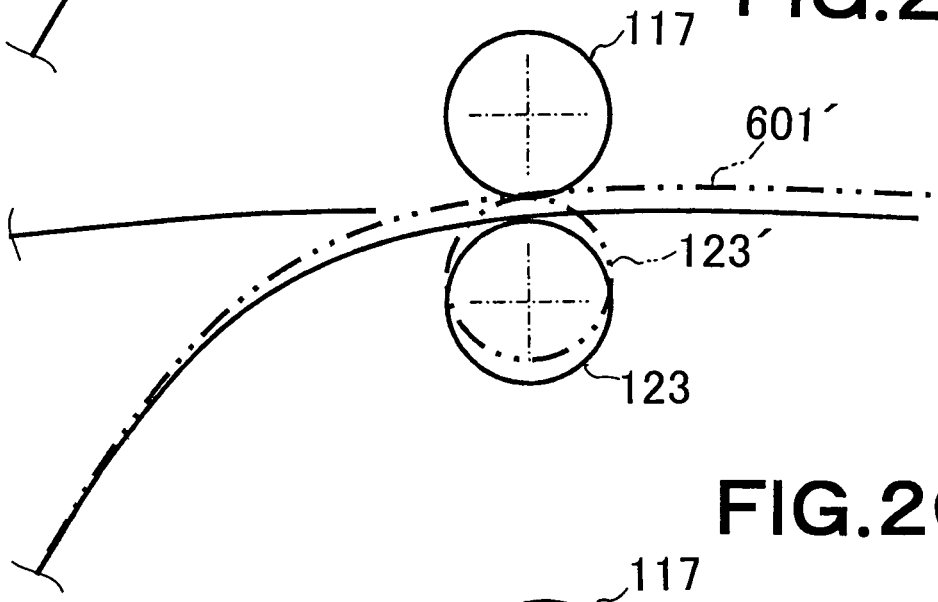
Figure 2C:
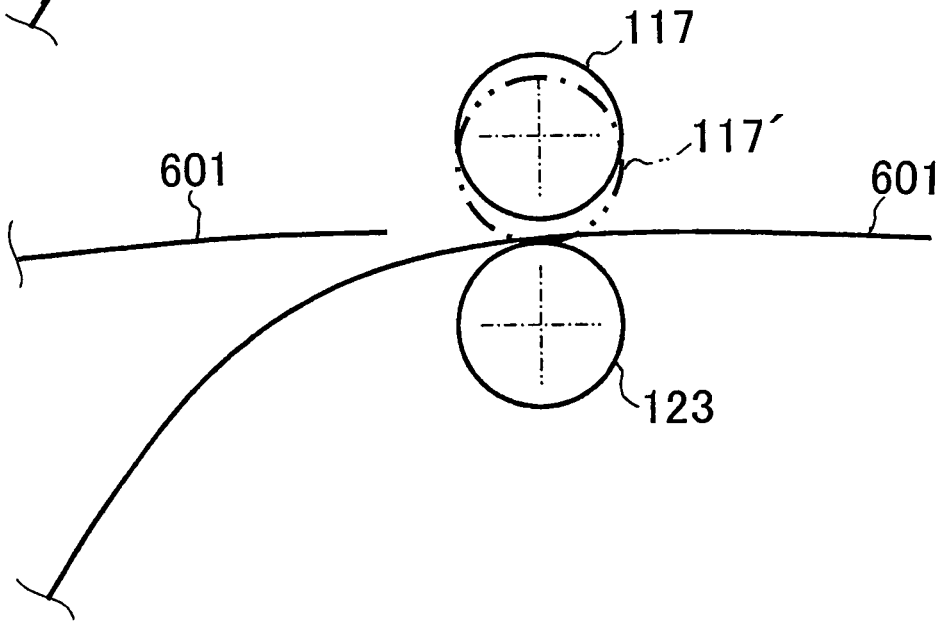
Figure 3:
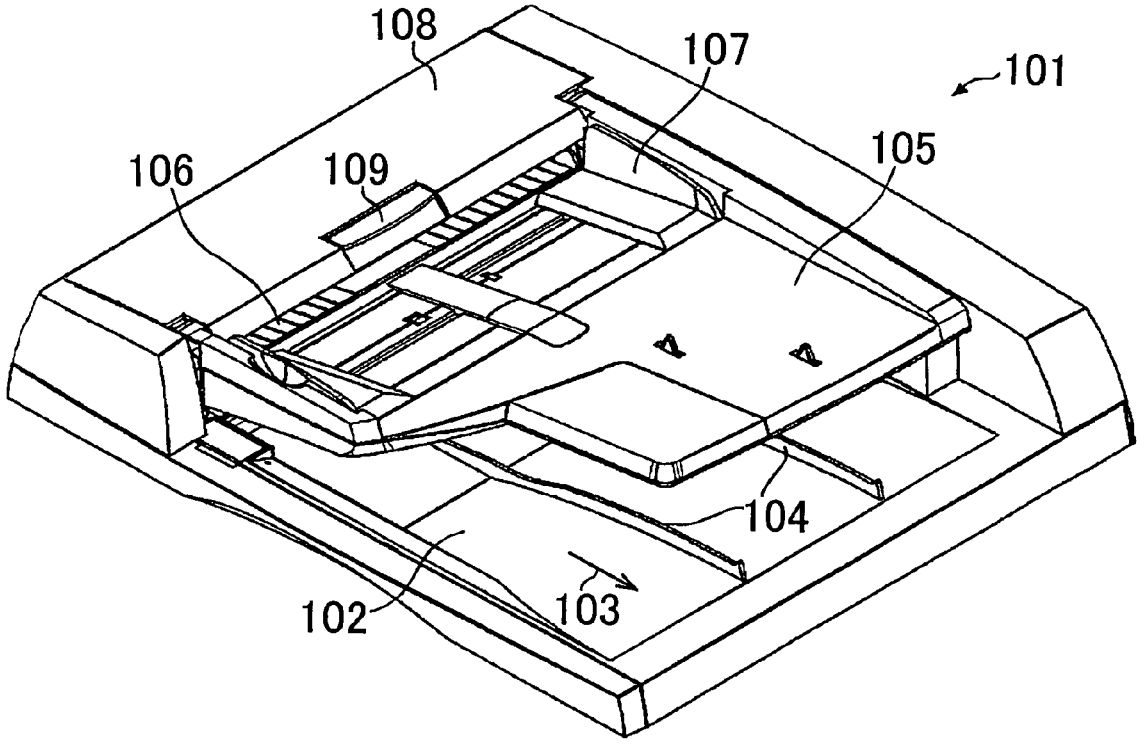
FIG. 3 is a perspective view of a double-sided document transport device according to the present invention.

FIG. 3 is a view showing an outside appearance of a double-sided document transport device according to the present invention. The document transport device 101 constitutes an upper section of a document reading apparatus, and the main body of the apparatus, which is disposed under the document transport device 101 and includes a scanner module composed of an optical system and the like for reading a document, an image processing circuit, a power supply circuit, and the like is not illustrated.

The document transport device 101 includes a stacker 102 extending horizontally so that it is mounted to the upper section to the main body of the apparatus described above. The stacker 102 is a place on which documents (not shown) having been read are stacked and has two rod-like projections 104 projecting from the bottom surface thereof along a document discharge direction shown by an arrow 103. A document tray 105 is disposed above the stacker 102 at a predetermined interval, and a document (not shown) is set on the document tray 105 so that the extreme end thereof is inserted into a document insert port 106 of the document tray 105. A document guide 107, which is movable in the width direction of a document, is attached in front of the document insert port 106 of the document tray 105.

An upper unit 108 is openably and closably disposed on the upper back side of the document insert port 106. The upper unit 108 can be turned about a predetermined fulcrum (not shown) by lifting up a handle 109 disposed above the center of the document insert port 106, thereby the inner space of the document insert port 106 can be opened in the vicinity of the inlet thereof With this arrangement, a jammed sheet in the apparatus can be removed.

Figure 4:
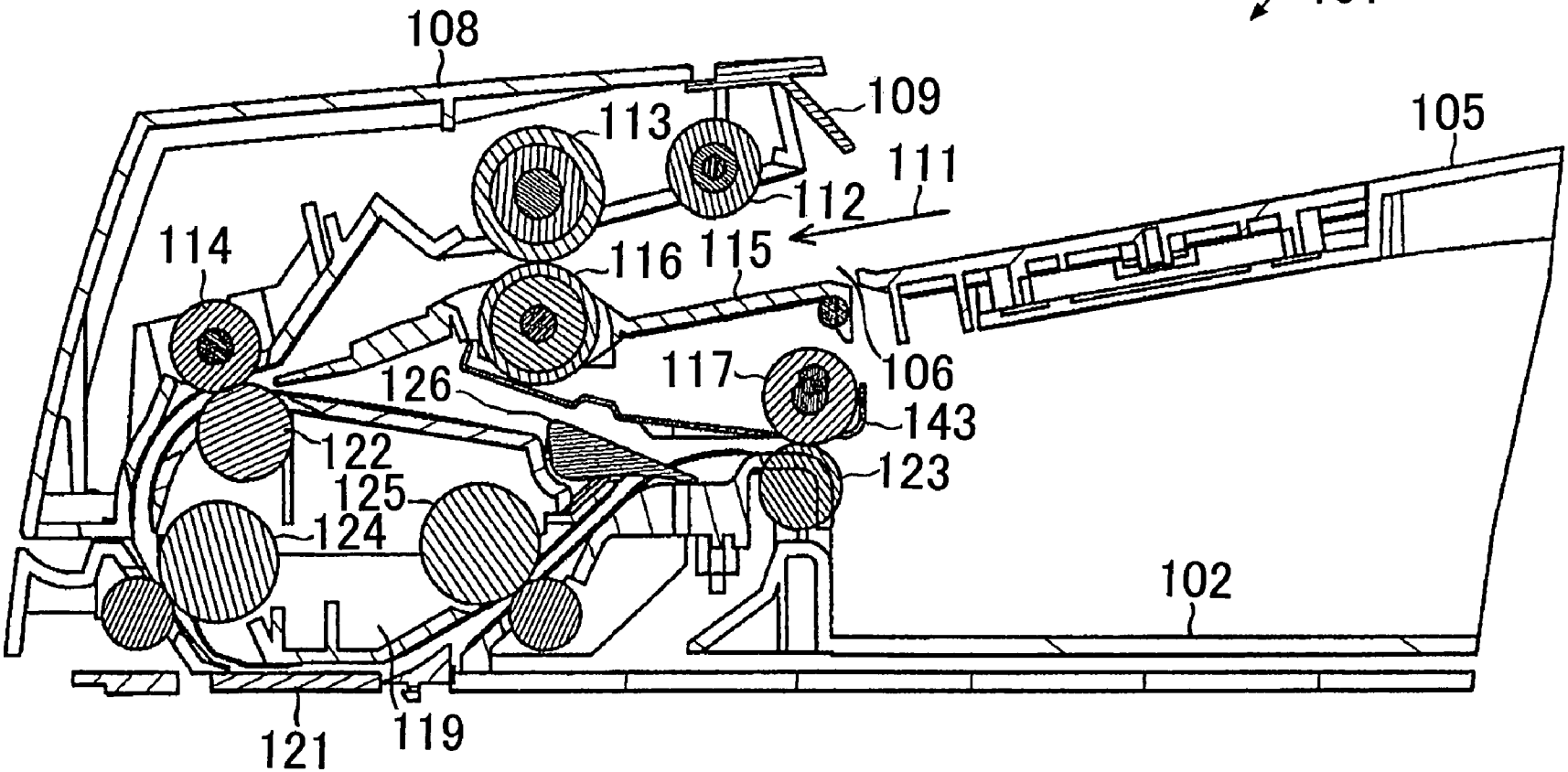
FIG. 4 is a sectional view of a document travel section.

FIG. 4 is a sectional view showing the inside structure of the document transport device 101. The document transport device 101 includes three units, that is, an upper unit 108, a middle unit 115, and a lower unit 119 for forming a document transport space. The upper unit 108 shown in FIG. 3 is disposed at an uppermost position in the figure. The upper unit 108 has a total of three rollers, that is, a guide roller 112 for guiding the extreme ends of documents sequentially inserted from the document insert port 106, a main feed roller 113 for feeding the documents inward, and a transport roller 114, and these rollers are disposed above the documents fed in the direction of an arrow 111 along the document tray 105.

The middle unit 115 is disposed just below the upper unit 108. The middle unit 115 has such a mechanism that it is also turned about another fulcrum as described later. The middle unit 115 includes a retard roller 116, which is in rotation contact with the main feed roller 113 of the upper unit 108, and discharge rollers 117 which discharge a document to the stacker 102 side and feeds a document into the device again when both the sides of the document are read. The discharge rollers 117 are drive rollers driven by a not shown drive source.

The lower unit 119 is disposed below the middle unit 115. A platen glass 121 is disposed to the opening of the bottom of the lower unit 119. The optical system and a read element are disposed to the main body of the apparatus (not shown) disposed below the platen glass 121 so that the image information recorded on a document passing through on the platen glass 121 is read. A transport roller 122, which is in rotating contact with the transport roller 114 of the upper unit 108, pinch rollers 123 which are in rotating contact with the discharge rollers 117, and other two pairs of transport rolls 124 and 125 are disposed in the lower unit 119. Further, flappers 126 each having a wedge-shaped cross section are disposed in front of the pinch rollers 123 in the lower unit 119 to switch a document transport direction.

How documents are transported in the document transport device 101 arranged as described above will be briefly described. First, an operation for reading only one side of a not shown document will be explained. The documents (not shown) set on the document tray 105 are fed toward the nip region between the main feed roller 113 and the retard roller 116 by the guide roller 112 which is lowered until it comes into contact with the uppermost layer of the documents and then rotated. Then, the documents are fed into the device one by one by the main feed roller 113 and the retard roller 116. The retard roller 116 is rotated in a direction opposite to that of the main feed roller 113 to prevent the double feeding of the documents when they are fed.

A document passed through between the main feed roller 113 and the retard roller 116 is transported onto the platen glass 121 after it passes through between the pair of transport rollers 114 and 122 and further between the pair of transport rollers 124. At the time, the image information recorded on a first side of the document is read using the read element described above. The document passes through the pair of transport rollers 125, pushes the wedge-shaped flappers 126 upward from under them, passes through between the pair of discharge rollers 117 and the pinch rollers 123, and is discharged onto the stacker 102. As described above, the documents set on the document tray 105 are fed into the document transport device 101 one by one, and the image information on the respective one sides (upper sides) of the documents (set on the document tray 105) is read.

Next, a case in which both the sides of a document are read will be explained. In this case, the image information recorded on a first side of a document fed into the document transport device 101 from the document tray 105 is read as described above. As the document is being read, it is fed to the stacker 102 by the pair of discharge rollers 117 and the pinch rollers 123 from the extreme end thereof At the time, the first side of the document from which the image information has been read faces downward.

As soon as the rear end of the document reaches the nip region between the pair of discharge rollers 117 and the pinch rollers 123, the rollers 117 and 123 begin to rotate reversely. Thus, the rear end of the document passes through on the upper surfaces of the flappers 126, travels in the boundary between the middle unit 115 and the lower unit 119 in an approximately horizontal direction, and passes through between the pair of transport rollers 114 and 122. Then, the document passes through between the pair of transport rollers 124 and is transported onto the platen glass 121. At the time, the read element reads the image information recorded on a second side of the document. The document passes through the pair of transport rollers 125, pushes the wedge-shaped flappers 126 upward from under them, passes through between the pair of discharge rollers 117 and the pinch rollers 123, and is discharged onto the stacker 102. The image information recorded on both the sides of the document is read as described above.

Figure 5:
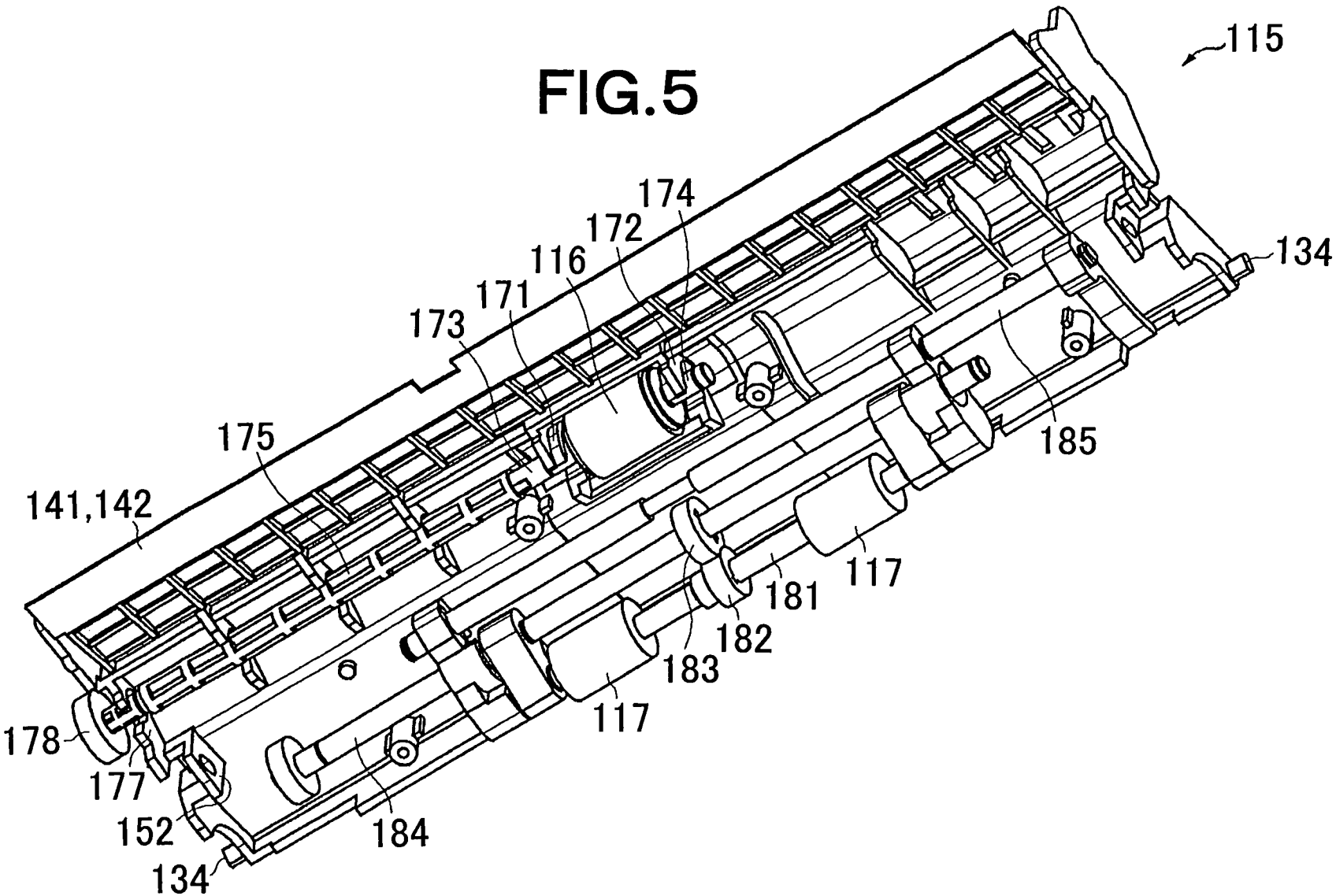
FIG. 5 is a perspective view of the vicinity of discharge rollers.

The middle unit 115 has an upper sub-unit 115*a*, and FIG. 5 shows the upper sub-unit 115*a* when it is viewed from below the middle unit 115. A pair of retard roller guides 171 and 172 each having a U-shaped cross section are disposed at approximately the center of the back surface of a sheet feed guide 141 constituting the upper sub-unit 115 so that they project from the periphery of the sheet feed guide 141 at a predetermined interval. The retard roller 116 has rotation shafts 173 and 174 independently pressed against the predetermined inner surfaces of the pair of retard roller guides 171 and 172 through bearings (not shown) by the press force of springs (not shown).

An end of a drive shaft 175 is attached to the one rotation shaft 173 to transmit drive force thereto. The drive shaft 175 is rotatably supported by a bearing 177 projecting from the back surface of the sheet feed guide 141 on the left end thereof in FIG. 5 so that it transmits the rotating force of a drive source (not shown) from a rotating force transmission mechanism 178 such as a gear and the like disposed on the left side of the bearing 177 in the vicinity thereof. The rotation shafts 173 and 174 of the retard roller 116 are independently supported by the two springs, respectively, thereby the retard roller 116 changes the position and the inclination of the center axis thereof according to the fluctuation of the thickness and the like of a document inserted between the retard roller 116 and the main feed roller 113 shown in FIG. 4. However, the length of the drive shaft 175 from the bearing 177 to the rotation shaft 173 is considerably longer than the length from the bearing 177 to the rotating force transmission mechanism 178. Accordingly, even if the position and the inclination of the retard roller 116 are fluctuated, the rotating force transmission mechanism 178 is not almost affected by the fluctuation so that it can smoothly transmit the drive force.

The pair of discharge rollers 117, to which drive force is transmitted by a single discharge roller final drive shaft 181, are attached to the side of the upper sub-unit 115*a* on which a rotation shaft 134 is attached. The discharge roller final drive shaft 181 receives the drive force transmitted from a reversible drive first transmission drive shaft 184 through rotation force transmission mechanisms 182 and 183 such as gears. The upper sub-unit 115*a* has a separation torque final transmission shaft 185 disposed approximately at the midpoint between the reversible drive fist transmission drive shaft 184 and the retard roller 116 in parallel with the reversible drive first transmission drive shaft 184. The separation torque final transmission shaft 185 transmits a torque load to separate the pair of discharge rollers 117 from the pinch rollers 123 shown in FIG. 4.

Figure 6:
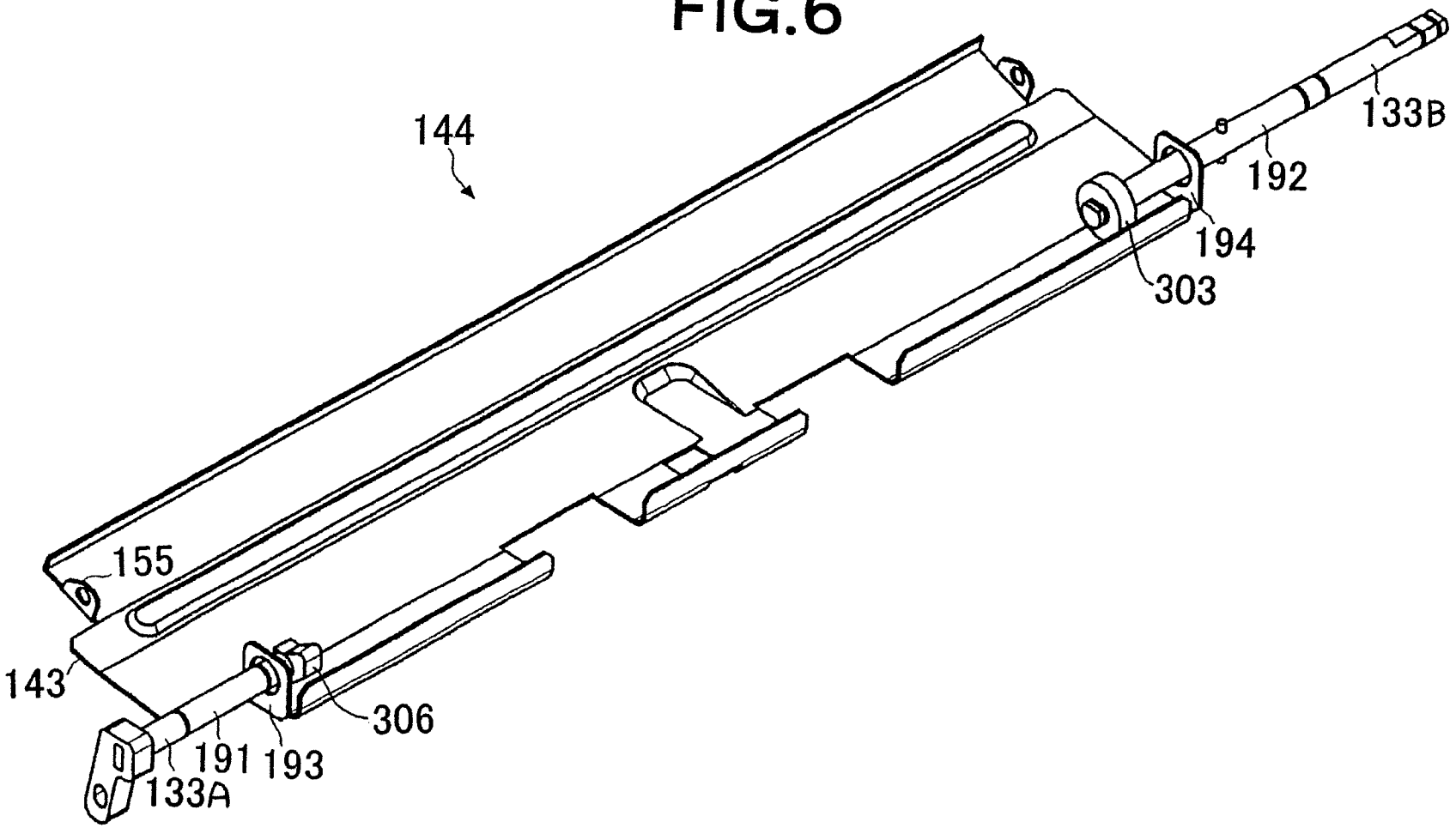
FIG. 6 is a perspective view of a part of a cancel/drive mechanism.

FIG. 6 shows a lower sub-unit 144 of the middle unit 115 when it is viewed from above it. A plate-shaped return guide 143 constituting the lower sub-unit 144 has second arm support portions 155 formed at both the ends thereof located on an upper portion in FIG. 6. Further, the return guide 143 has bearing portions 193 and 194 formed at both the ends thereof located on a lower portion, and the bearing portions 193 and 194 journal a separation torque intermediate transmission shaft 191 and a reversible drive second transmission drive shaft 192, the separation torque transmission intermediate shaft 191 being coaxially coupled to a t-separation torque rotation shaft 133A, and the reversible drive second transmission drive shaft 192 being coaxially coupled to the reversible drive primary shaft 133B.

The separation torque intermediate transmission shaft 191 transmits the torque load to the discharge rollers 117 and the pinch rollers 123, to which the press force is applied by the springs (not shown), through the separation torque final transmission shaft 185 shown in FIG. 5 as described above, in order to separate the rollers 117 from the rollers 123. Further, the reversible drive second transmission drive shaft 192 transmits drive force to the reversible drive first transmission drive shaft 184 shown in FIG. 5 to thereby drive the pair of discharge rollers 117 in rotation.

In the document transport device 101 of the embodiment arranged as described above, a document is inserted between the main feed roller 113 and the retard roller 116 in the state that the upper unit 108, the middle unit 115, and the lower unit 119 are disposed sequentially overlapping relation with each other. At the time, the main feed roller 113 is rotated in the transport direction of the document, whereas the retard roller 116 is rotated in a direction opposite to the above direction with predetermined torque. The document is fed between the upper unit 108 and the middle unit 115, one side of the document is read while it passes through the lower unit 119, and then the document is discharged onto the stacker 102. However, when both the sides of the document is read, the rear end of the document is detected by a sensor (not shown) at the time the rear end passes through the flappers 126, and, at this moment, the discharge rollers 117 begin reverse rotation. With this operation, the document passes through the interval between the flappers 126 and the return guide 143 of the middle unit 115 and is guided again onto the platen glass 121 as described above, thereby the other side of the document is read. When the document passes through on the flappers 126, it is less jammed on the flappers 126 because the return guide 143 is disposed above the flappers 126 as a guide plate. The document the image information recorded on both the sides of which has been read is discharged onto the stacker 102.

Figure 7:
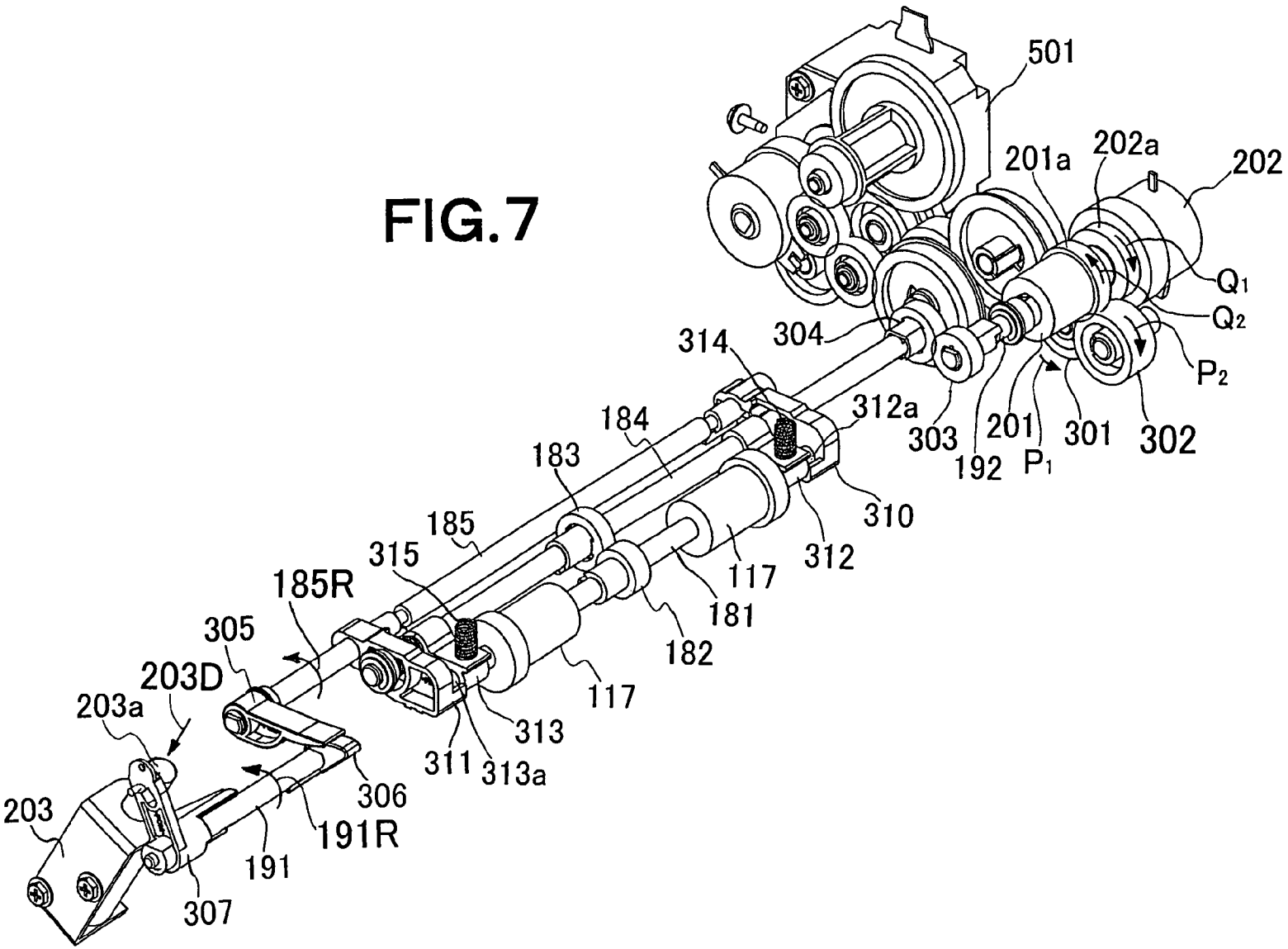
FIG. 7 is a perspective view of a main portion of the vicinity of the discharge rollers.
Figure 8A:
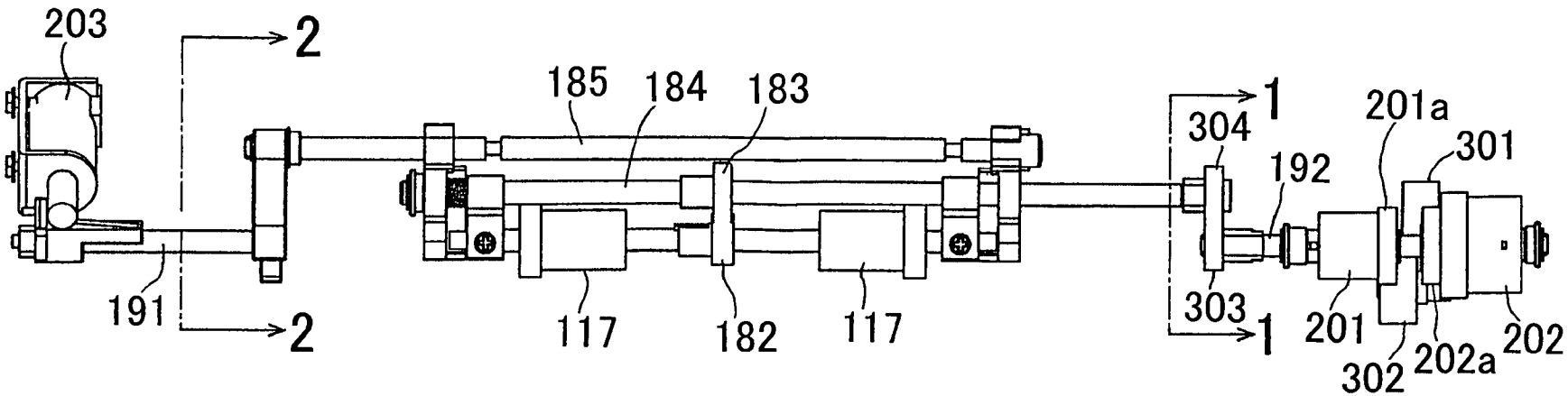
FIGS. 8A and 8B are plan views of the main portion of the vicinity of the discharge roller shown in FIG. 7.
Figure 8B:
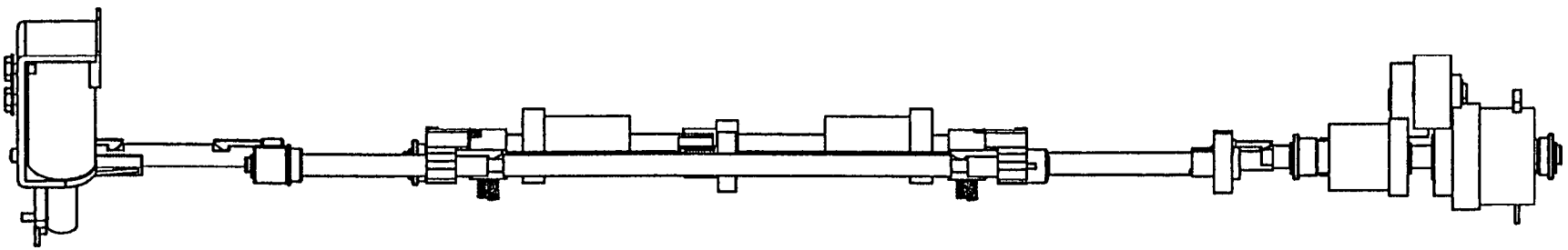
Figure 9A:
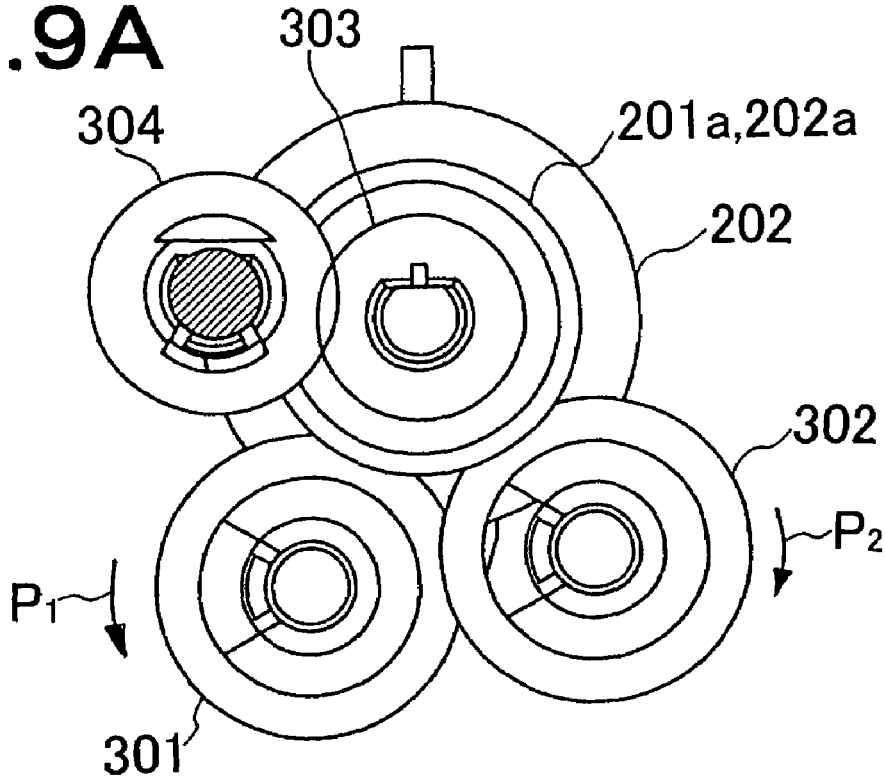
Figure 9A:
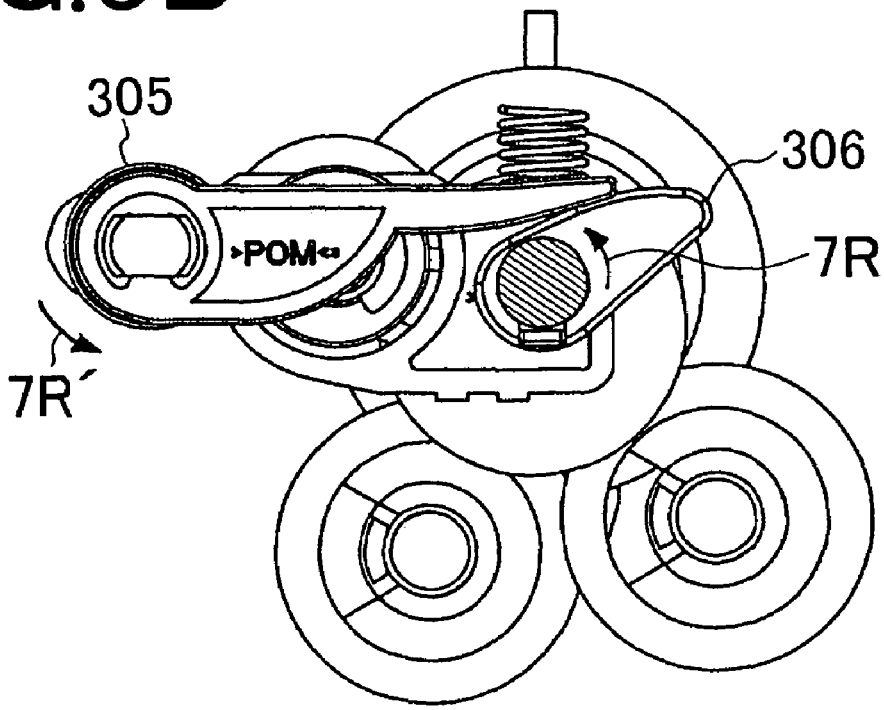

FIG. 7 is a perspective view of a drive mechanism, a cancel mechanism, and a press force application mechanism disposed in the vicinity of the discharge rollers and acting as main components of the present invention. The discharge rollers 117 are attached to the drive shaft 181 and driven by the driven gear 182 together with the drive shaft 181. The drive shaft 181 is supported by arms 312 and 313 at both the ends thereof. The arms 312 and 313 are supported to rotate about the drive shaft 184. The gear 182 is guaranteed to be meshed with the drive gear by the arms 312 and 313. Springs 315 and 314 come into contact with the arms 313 and 312 on the sides thereof near to the drive shaft 181 so as to press the drive shaft 181 vertically downward. The shaft 184 is supported by a frame. Further, one end of each of the springs 314 and 315 is also in contact with the frame. A gear 304 is attached to an end of the shaft 184. The gear 304 is driven by a gear 303. The gear 303 is driven from the outside through the shaft 192.

There are two routes through which drive force is transmitted from a motor 501 to the reversible drive second transmission drive shaft 192. A first route travels from the motor 501 to a gear 301 through a speed reduction mechanism and further travels from the gear 301 through a gear 202*a* of an electromagnetic clutch 202 on the reversible drive second transmission drive shaft 192. A second route travels from the motor 501 to the gear 301 likewise and further travels through a gear 302 and a torque limiter 201 on the reversible drive second transmission drive shaft 192.

The arms 312 and 313 have projections 312*a* and 313*a* formed on the outsides thereof. Arms 310 and 311 are disposed under the projections 312*a* and 313*a* at predetermined intervals. The arms 310 and 311 are fixed to the separation torque final transmission shaft 185. The separation torque final transmission shaft 185 is rotatably supported by the frame. A lever 305 is disposed to an end of the separation torque final transmission shaft 185 and combined with a lever 306 on the separation torque intermediate shaft 191. A link 307 is attached to the other end of the separation torque intermediate shaft 191 and driven by a solenoid 203.

An operation of the drive system will be explained with reference to FIGS. 8A and 8B and FIGS. 9A, 9B. When the motor 501 is driven in a predetermined direction, the gear 301 is rotated in the direction of an arrow P1. Since drive force is transmitted to a gear 201*a* of the torque limiter 201 from the gear 301 through the gear 302, it is rotated in the direction of an arroe Q2. As a result, predetermined torque is applied to the reversible drive second transmission drive shaft 192 through the torque limiter 201. When the electromagnetic clutch 202 is turned off, the reversible drive second transmission drive shaft 192 is rotated in the direction of the arrow Q2. The gear 202*a* of the electromagnetic clutch 202 is rotated in the direction of an arrow Q1 because it is meshed with the gear 201*a*. When the electromagnetic clutch 202 overcomes the torque of the torque limiter 201, thereby the reversible drive second transmission drive shaft 192 is rotated in the direction of the arrow Q1.

As described above, when the electromagnetic clutch 202 is turned off, the shaft 192 is rotated in the direction of the arrow Q2, whereas when the electromagnetic clutch 202 is turned on, it is rotated in the direction of the arrow Q1. As a result, the discharge rollers 117 can be rotated in both the directions of the forward direction and the rearward direction. Note that it is preferable to set the same gear ratio to the discharge rollers 117 when they are rotated in both the forward and rearward directions so that a document can be smoothly delivered between the rollers located forward and rearward of the discharge rollers 117.

Next, an operation for separating the discharge rollers 117 will be explained. When a plunger 203*a* of the solenoid 203 is retracted in a direction 203D, the link 307 is pulled, thereby the shaft 191 is rotated in a direction 191R. As a result, the lever 306 is rotated likewise and pushes the lever 305 upward, thereby the shaft 185 is rotated in a direction 185R, and thus the arms 310 and 311 are rotated likewise. As a result, the arms 312 and 313 are pushed upward, thereby the discharge rollers 117 are finally separated.

Next, an operation for separating the discharge rollers 117 in a both-side document transport operation will be explained. As soon as the rear end of a document reaches the nip region between the discharge roller 117 and pinch roller 123 after the image information recorded on a first side thereof is read, the pair of discharge rollers 117 and the pinch rollers 123 begin to rotate reversely. Thus, the rear end of the document passes through on the upper surface of the flappers 126, travels in the boundary between the middle unit 115 and the lower unit 119 in an approximately horizontal direction, and passes through between the pair of transport rollers 114 and 122. Then, the document passes between the pair of transport rollers 124 and is transported onto the platen glass 121. At the time, the read element reads the image information recorded on a second side of the document. Although the document passes through the pair of transport rollers 125, pushes the wedge-shaped flappers 126 upward from under them, and travels toward the pair of discharge roller 117 and pinch roller 123, the discharge rollers 117 are rotated reversely at the time. Accordingly, a controller (not shown) sends a signal to the solenoid 203 to separate the discharge rollers 117 from the pinch rollers 123, thereby the document passes through between the pair of discharge rollers 117 and the pinch rollers 123. At the time, the surfaces of the discharge rollers 117 are separated above the lower surface of the return guide 143 so that the surfaces of the discharge rollers 117 do not come into contact with the document.

When an end of the document is detected by a sensor in a reverse path, the discharge rollers 117 are rotated forward to thereby cancel the separating operation, and the document is clamped again between the pair of roller 117 and the pinch rollers 123 and discharged onto the stacker 102.

Note that the document transport device for transporting a document is explained in the embodiment, the present invention can be also applied a document transport device for transporting a sheet other than a document by the same mechanism.

What is claimed is:

1. A double-sided document transport device for separating documents one by one from a bundle of the stacked documents, transporting a document to a reading position, and then transporting the document to the reading position again through a reverse path, the device comprising:

main feed rollers constructed and arranged to transport a document separated from the stack of documents inward toward the reading position;

transport rollers constructed and arranged to transport the document to the reading position, and from the reading position to a discharge position; and a discharge transport unit, comprising discharge rollers located at the discharge position, pinch rollers arranged under said discharge rollers, for pressing a document against the discharge rollers from under the discharge rollers, flappers having a wedge-shaped cross-section disposed between the transport rollers and the pinch rollers to switch a document transport direction, a document transported by the transport rollers toward the discharge position passing under and pushing the flappers upward, a document guide surface positioned above the flappers proximal the discharge position and between the discharge rollers and the transport rollers, a reversible drive, constructed and arranged to rotate the discharge rollers in a rotating direction changeable between a discharge direction and a reverse direction opposite the discharge direction, rotation in the reverse direction commencing when an end of a document having first passed the reading position reaches a nip region between the discharge rollers and the pinch rollers causing the document to pass over the flappers and under the document guide surface toward the transport rollers to again pass the reading position, and a discharge roller separation actuator constructed and arranged to selectively move the discharge rollers between a clamp position with the pinch rollers and upwardly away from the pinch rollers to separate the discharge rollers from the pinch rollers, the discharge roller separation actuator being operable to separate the discharge rollers from the pinch rollers after the document is engaged by the transport rollers, the reversible drive rotating the discharge rollers in the discharge direction and the discharge roller separation actuator moving the discharge rollers downwardly into contact with the pinch rollers when the end of the document is detected to discharge the document.

2. A double-sided document transport device according to claim 1, wherein the reversible drive includes a drive motor, a reversible drive transmission drive shaft coupled to the drive motor by a first drive route and a second drive route, and a discharge roller final drive shaft coupled to the reversible drive transmission drive shaft, the discharge final drive shaft being attached to the discharge rollers, wherein the first drive route includes an electromagnetic clutch, and the second drive route includes a torque limiter, the second drive route constructed and arranged to drive the reversible drive transmission drive shaft and discharge rollers in a reverse direction with respect to the first drive route through the torque limiter, wherein the drive motor for driving the discharge rollers is constructed and arranged to be rotated in the same direction at all times from the beginning of a reading operation of a first document of the bundle of the stacked documents to the end of a reading operation of a final document of the bundle of the stacked documents, wherein the electromagnetic clutch and the torque limiter are constructed and arranged such that when the electromagnetic clutch is turned off the first drive route is not coupled to the second drive route, such that the drive motor rotating in said same direction rotates, through the reversible drive transmission drive shaft, the discharge rollers in a given direction, and wherein the electromagnetic clutch and the torque limiter are constructed and arranged such that when the electromagnetic clutch is turned on, the first drive route is coupled with the second drive route, and the torque for driving the reversible drive transmission drive shaft and discharge rollers through the electromagnetic clutch is larger than the torque for driving the discharge rollers through the torque limiter, such that the drive motor rotating in said same direction rotates, through the reversible drive transmission drive shaft, the discharge rollers in a direction reverse to said given direction.

3. A double-sided document transport device according to claim 2, further comprising springs constructed and arranged to urge said discharge rollers toward said clamp position, arms constructed and arranged to rotatably support said reversible drive transmission drive shaft and said discharge roller final drive shaft coupled to said reversible drive transmission drive shaft, wherein said discharge roller separation actuator includes a lever constructed and arranged for selectively urging against at least one of said arms, to move said discharge rollers from said clamp position upwardly away from the pinch rollers, wherein the reversible drive transmission drive shaft and the shaft of the discharge rollers final drive shaft are coupled together with gears meshed with each other, and wherein the arms are connected together by a torque transfer.

4. A double-sided document transport device according to claim 3, further comprising a torque receiving lever connected to one of said arms, wherein:

said discharge roller separation actuator includes a separation torque intermediate shaft, a solenoid for selectively rotating said separation torque intermediate shaft and a turn lever attached to said separation torque intermediate shaft, said turn lever constructed and arranged to contact said torque receiving lever to urge movement of said discharge rollers from said clamp position upwardly away from the pinch rollers in response to said solenoid selectively rotating said separation torque intermediate shaft.

5. A double-sided document transport device according to claim 3, wherein the reversible drive transmission drive shaft is coupled with the first and second drive routes by a reversible drive transmission second drive shaft through gears.

* * * * *